US007044684B2

(12) United States Patent
Hoelting et al.

(10) Patent No.: US 7,044,684 B2
(45) Date of Patent: May 16, 2006

(54) PLOW BLADE WITH WATER PASSAGEWAY

(75) Inventors: Keith A. Hoelting, Allerton, IA (US); James V. Reeves, Leighton, IA (US); Brian N. Kenkel, Montezuma, IA (US)

(73) Assignee: Vermeer Manufacturing Company, Pella, IA (US)

( * ) Notice: Subject to any disclaimer, the term of this patent is extended or adjusted under 35 U.S.C. 154(b) by 190 days.

(21) Appl. No.: 10/396,619

(22) Filed: Mar. 25, 2003

(65) Prior Publication Data

US 2004/0200627 A1 Oct. 14, 2004

(51) Int. Cl.
*E02F 5/10* (2006.01)

(52) U.S. Cl. ..... 405/180

(58) Field of Classification Search ..... 405/180, 405/181, 182, 183, 174; 172/196, 149, 140; 111/119, 121
See application file for complete search history.

(56) References Cited

U.S. PATENT DOCUMENTS 3,618,538 A * 11/1971 Brannan ..... 111/186
3,777,500 A 12/1973 Kelley
4,033,271 A * 7/1977 Williams et al. ..... 111/123
4,047,387 A * 9/1977 Tamura et al. ..... 405/38
4,498,813 A * 2/1985 Nelson et al. ..... 405/182
4,592,294 A * 6/1986 Dietrich et al. ..... 111/123
4,719,862 A * 1/1988 Edmisson ..... 111/123
5,119,888 A * 6/1992 Hall ..... 172/699
5,261,170 A * 11/1993 Ward ..... 37/451
5,452,673 A * 9/1995 Bruce ..... 111/119
6,474,909 B1 11/2002 Malek
2004/0205987 A1 10/2004 Wasserburger

* cited by examiner

*Primary Examiner*—John Kreck
(74) *Attorney, Agent, or Firm*—Sturm & Fix LLP

(57) ABSTRACT

A plow blade having a fluid passageway and points of fluid ejection is produced with basic manufacturing processes allowing for efficient production. The blade construction has a multiple component assembly for providing the ability to rebuild a blade and replacing a portion of the blade that may be worn. In another aspect of the invention a process of ejecting a specific fluid at specific points along a plow blade the desirable characteristics are maximized, while the volume of ejected fluid is minimized. This method is adaptable in static plowing and vibratory plowing utilities since lubricating the sides of the blade/chute that come into contact with the ground with fluid has been found to greatly reduce the amount of drag (friction).

3 Claims, 7 Drawing Sheets

PLOW BLADE WITH WATER PASSAGEWAY

STATEMENT REGARDING FEDERALLY SPONSORED RESEARCH OR DEVELOPMENT

Not Applicable

BACKGROUND OF THE INVENTION

Many types of services are delivered to homes through conduits installed in relatively shallow underground trenches. These include telephone, television, natural gas, electricity, and drainage. These utilities are often installed with a plow. FIG. 1 illustrates an example installation of a utility 20 with a prior art plowing process. A plow 30 is attached to a prime mover, typically a tractor 10. The tractor 10 propels the plow through the ground. The plow 10 is relatively narrow and will split the ground open with a sharpened steel blade. The utility line 20 is introduced into the ground through a chute 40 that is attached to and directly behind the blade. The chute 40 holds the ground open as the utility line 20 is being fed into the desired vertical position and places the utility line 20 into a horizontal position at the desired depth under ground.

An alternate configuration is illustrated in FIG. 2 where the utility line 20 is laid out on the ground behind its intended position and then the plow 30 is connected to one end. The plow is then pulled through the ground in order to pull the utility line 20 into the correct position. In this configuration there is no chute.

Depending on the desired depth, size of utility line, and the ground (soil) conditions (clay, sand, loam, etc.). This process may be slow and require a large amount of power from the tractor 10 to pull the blade/chute through the ground. To reduce this loading various efforts have been made to inject liquid to the plow and to the utility being installed to wet the ground.

In some past designs the liquid was water, ejected in the direction of travel of the plow blade, and at the edge of the plow blade, utilizing the water to assist in the cutting action required to slice the ground.

In other designs, useful for applications as illustrated in FIG. 2, the liquid has been water directed to the area around the utility line being pulled through the ground to lubricate and reduce the frictional drag.

In still other designs water has been directed through long holes 36 drilled into the blade 34 of the plow 30. Additional cross-drilled holes threaded to accept cooperating nozzles 38 are drilled near front edge 32, as illustrated in FIGS. 3 and 4. Water was then pumped into inlet fitting 37 to route water to the sides of the plow. This design has proven successful as the lubrication provided by the water significantly reduces the power necessary to pull the plow. However this requires complicated manufacturing processes, with the result that a wear item, the blade, becomes a relatively expensive component. There exists a need for a blade to provide this water distribution in a manner that is less expensive to initially manufacture and to maintain.

BRIEF SUMMARY OF THE INVENTION

The present invention relates to a novel design for a plow blade which provides a fluid passage and points of fluid ejection which is produced with basic manufacturing processes allowing efficient production.

Another aspect of the present invention is a blade construction including a multiple component assembly. This provides the ability to rebuild a blade, replacing a portion of the blade that may be worn.

In another aspect of the present invention a process of ejecting a specific fluid at specific points along a plow blade the desirable characteristics are maximized, while the volume of ejected fluid is minimized. This method is adaptable in static plowing and vibratory plowing utilities. Lubricating the sides of the blade/chute that come into contact with the ground with fluid has been found to greatly reduce the amount of drag (friction).

DETAILED DESCRIPTION OF THE INVENTION

Figure 1:
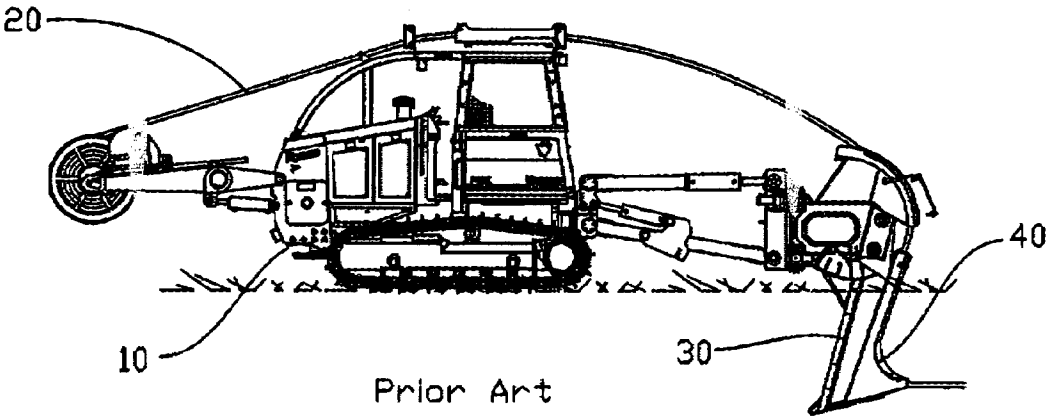
Prior Art Fig. 1
FIG. 1 is a side view of a prior art tractor propelling a plow through the ground and installing a utility line that is being ejected through a chute attached to the plow.

Referring now to the drawings, like reference numerals designate identical or corresponding parts throughout the several views. The included drawings reflect the current preferred and alternate embodiments. There are many additional embodiments that may utilize the present invention. The drawings are not meant to include all such possible embodiments.

Figure 2:
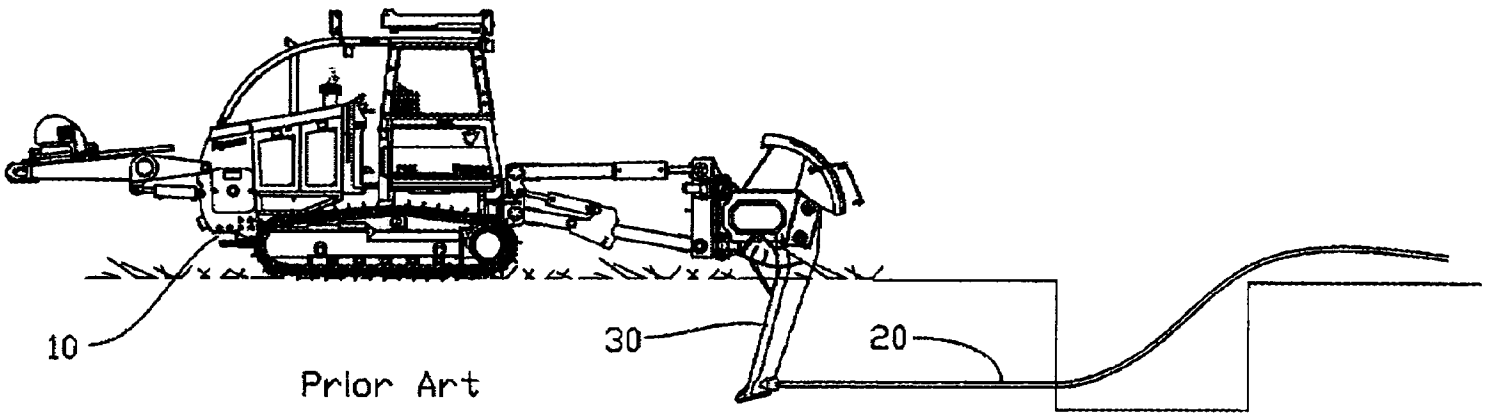
Prior Art Fig. 2
FIG. 2 is a side view of a prior art tractor propelling a plow through the ground and installing a utility that is being pulled through the ground and attached to the plow.
Figure 3:
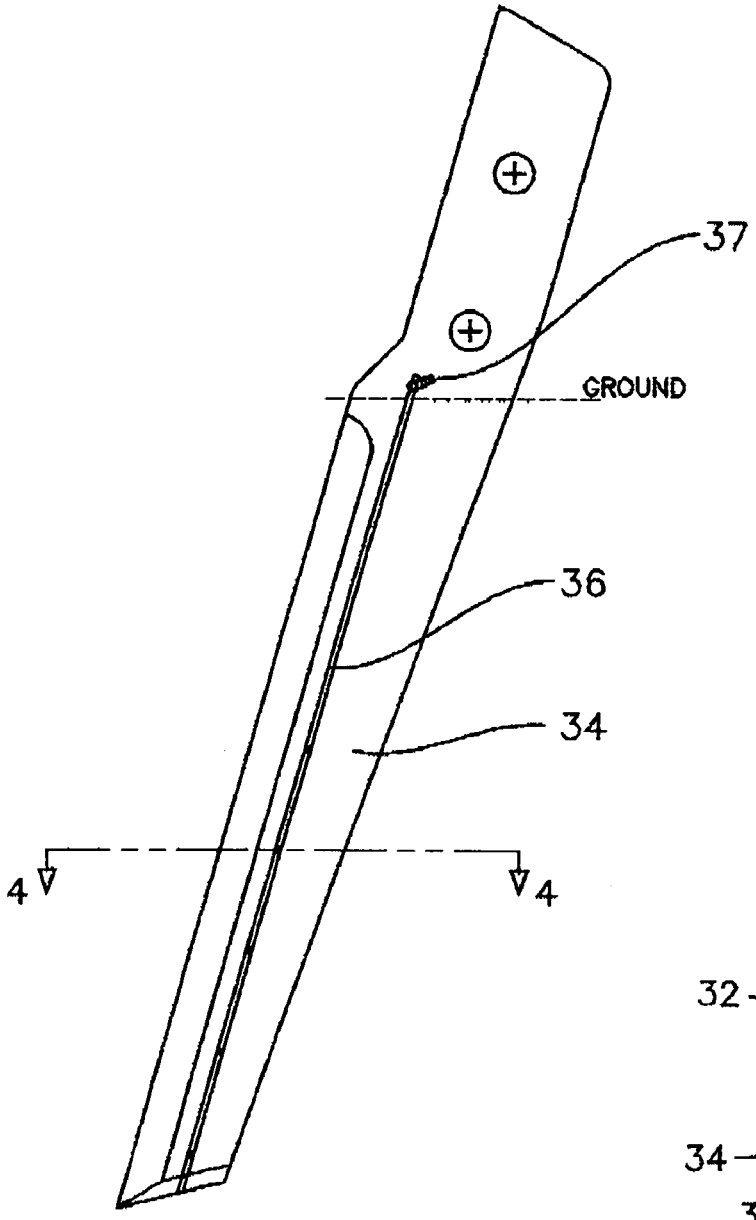
Prior Art Fig 3
FIG. 3 is side view of a prior art plow.
Figure 4:
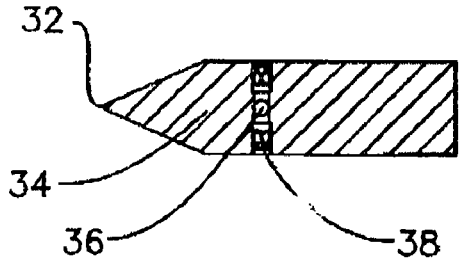
Prior Art Fig. 4
FIG. 4 is cross section of the prior art plow taken along line 4—4 as illustrated in FIG. 3.
Figure 5:
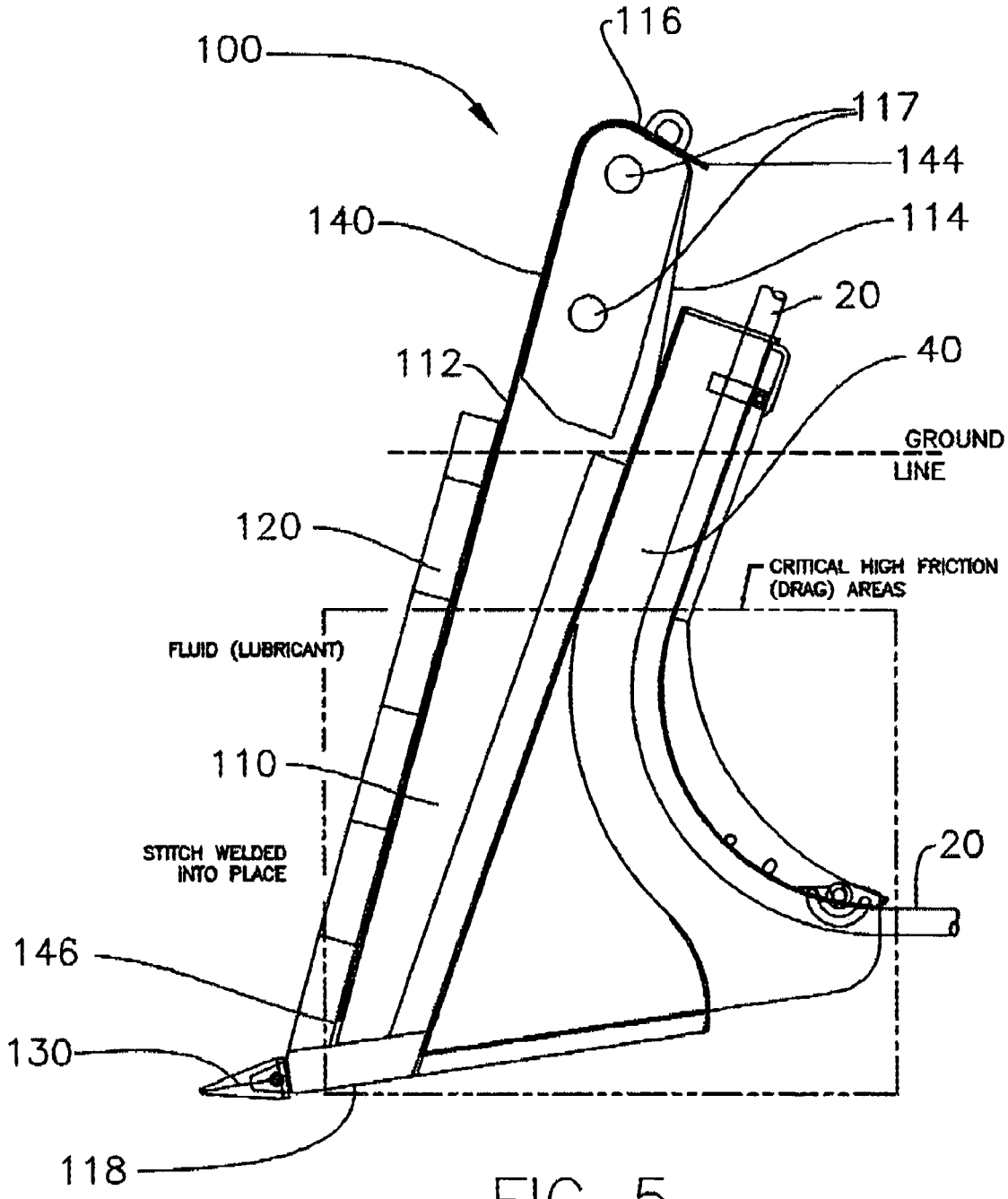
FIG. 5 is a side view of one embodiment of a plow constructed in a manner of the present invention.

FIG. 5 illustrates a plow 100 constructed according to the principles of the present invention. Plow 100 consists of blade 110, leading edge sections 120, point 130 and a fluid tube 140. Chute 40 is attached to the rear edge 114 of blade 110, and is constructed to receive and guide utility line 20 from above the ground to the desired depth where it is oriented generally parallel to the ground surface. In other embodiments, the chute may be replaced by a puller adapted to hold a utility line that is being pulled through the ground, similar to the arrangement shown in FIG. 2.

The blade 110 further includes a front edge 112, a top end 116 and a bottom end 118. The top end 116 includes apertures 117 which will serve as attachment points, to adapt to a power unit. Many different types of power units can be used in conjunction with the preset invention.

The bottom end 118 is adapted to support a variety of points 130. The type of point to be installed may be dependent upon the soil conditions of a particular job.

Figure 8:
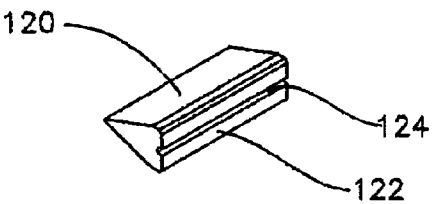
FIG. 8 is an isometric view of a front edge section.

A component of the present invention is the manner in which the components are assembled to form flow paths for fluid to exit the blade at controlled locations and with a controlled flow rate. The flow paths of this first embodiment illustrated in FIG. 1 are defined when the front edge 120 is attached to the blade 110. FIG. 8 illustrates a void 124 in surface 122 of leading edge section 120. Fluid tube 140 is adapted to travel in void 124 to transfer pressurized fluid from the top of plow 100 into the void 124, and may be sealed with weld 152 illustrated in FIG. 6. Other forms of sealing the connection between the tube 140 and the front edge sections 120 are possible, but are not illustrated herein as they are not a critical element of the present invention. Tube 140 has a top end 144 and a bottom end 146 and may extend into void 124 for any desired distance, as will be explained later.

Figure 7:
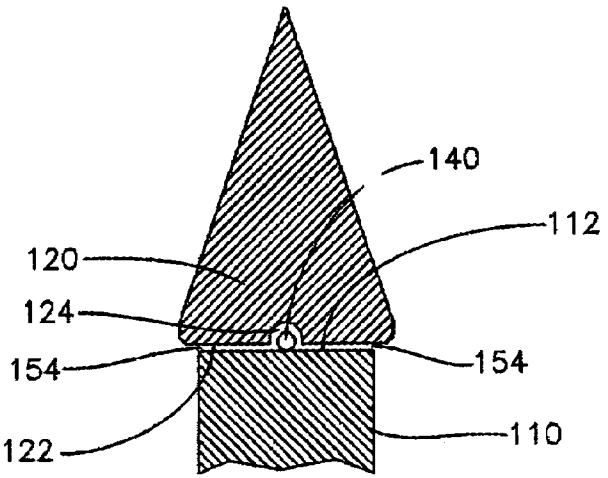
FIG. 7 is a cross-section taken along plane 7—7 as illustrated in FIG. 6.
Figure 6:
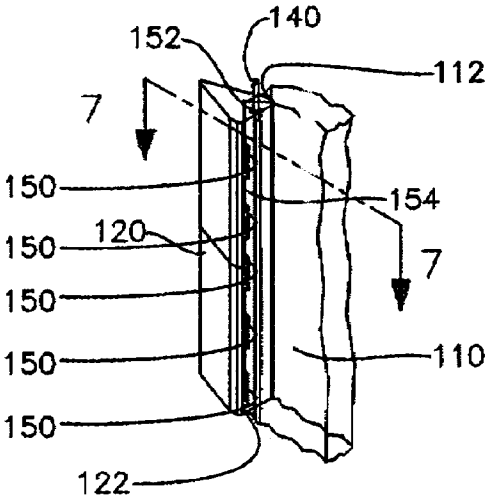
FIG. 6 is an isometric view of a portion of another embodiment of the plow of the present invention.

As illustrated in FIGS. 6 and 7 the leading edge sections are attached to blade 110 with stitch welds 150. Flow paths are defined by providing a small gap 154 between the front surface 112 of the blade and the rear surface 122. The spaces between the stitch welds 150 results a flow path for the pressurized fluid, allowing fluid to pass from the void 124, through the gap 154 between surfaces 122 and 112, and out between the stitch welds 150. In this manner, the location and length of the stitch welds 150 defines the location at which the fluid will exit the blade 110. The gap 154 (FIG. 7) between the surfaces 112 and 122 combined with the total amount of weld gap will define the volume at which the fluid will be ejected from the blade 110 at a certain fluid pressure.

Figure 15:
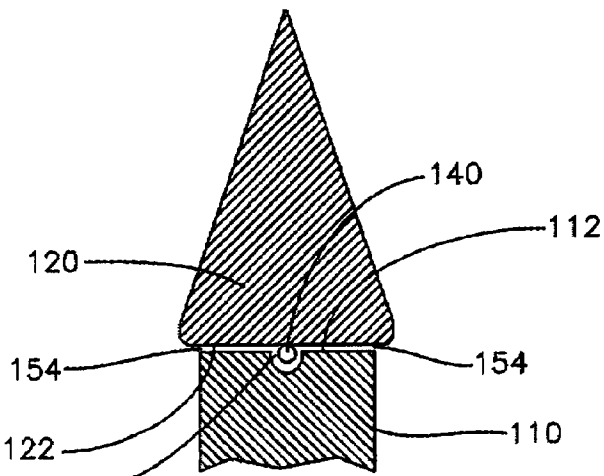
FIG. 15 is a view like FIG. 7 but showing an alternate embodiment with the void or channel formed in the blade instead of in the back of the front edge section.

FIG. 15 shows an alternate arrangement of the FIG. 7 structure, having the void or groove 224 formed in the front of the blade instead of having the void or groove 124 formed in the back of the leading edge section as shown in FIG. 7.

The fluid pressure at a certain point along the blade's length will vary. If the tube 140 terminates at the top of blade 110, the fluid pressure will be highest at that point and will decrease at points closer to the bottom. This is not ideal as there tends to be more resistance from the soils near the bottom of the blade, which requires the highest fluid pressure near that area. This is due to the types of soils typically encountered at lower depths. The surface soils typically include some percentage of organic matter, and higher percentage of air pockets: it is typically less dense. The soils encountered at points deeper can include the more difficult soils including clay. Thus there is an area, illustrated in FIG. 5, as a critical high friction area. This is the area in which the fluid is most critical. In order to assure that the fluid is ejected most aggressively in this area tube 140 can be extended so that it terminates at a position towards the bottom of this critical high friction area, the tube end 146 is located near the bottom end 118 of the blade 110. The fluid pressure in void 124 will be highest at the point the tube terminates. In this manner the volume of fluid at this point can be maximized.

In addition to varying the length of tube 140, the number of leading edge sections 120 that are welded onto blade 110 can be-varied to match the requirements of a specific job, including specific installation depths. The number of and location of the stitch welds can also be adjusted to tailor a plow 100 for a specific application. In this manner it is possible to provide a nearly infinite variety of configurations in an economic manner.

Figure 10:
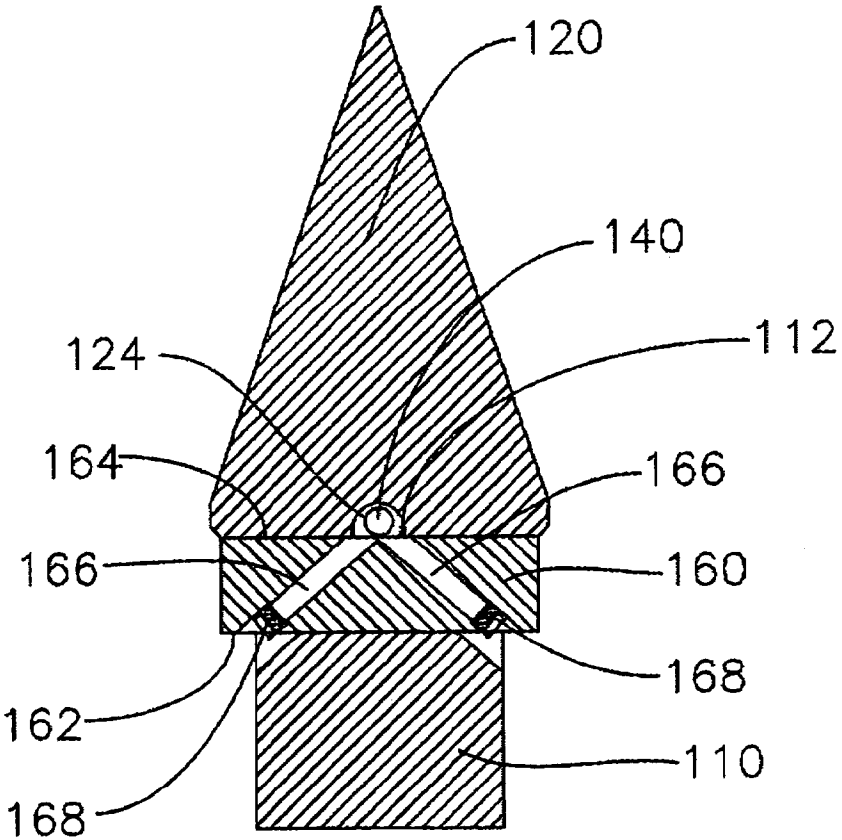
FIG. 10 is a cross-section taken along plane 10—10 as illustrated in FIG. 9.
Figure 9:
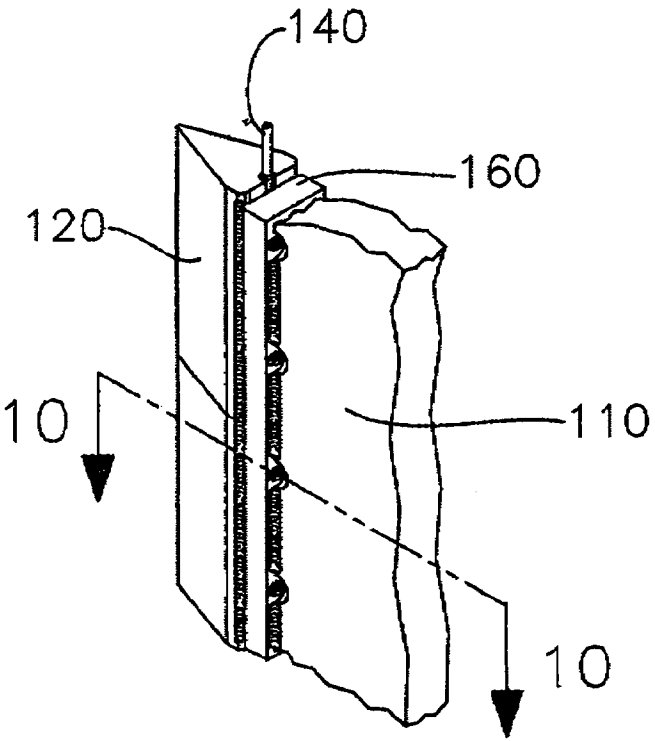
FIG. 9 is an isometric view of a portion of still another embodiment of the plow of the present invention.

Another embodiment is illustrated in FIGS. 9 and 10. In this configuration a manifold 160 is installed in between the blade 110 and the leading edge sections 120. The manifold includes drilled holes 166 extending from a front side 164 to a rear side 162, as illustrated in FIG. 10. The drilled holes 166 intersect at the middle, and when the leading edges 120 are installed onto the front side 164 the drilled holes 166 will terminate at the void 124 in the leading edge 120. In this manner a flow path is defined by the void 124 and the holes 166 which will allow fluid to be routed from tube 140 to nozzles 168 that are installed at the rear side 162 of the manifold 160.

In this embodiment varying the nozzles 168 utilized in the assembly allows control of the flow rates and location of the fluid injection. The nozzles 168 can be replaced by plugs (not shown) if there are areas where fluid is not required, and the size of the nozzles 168 can be varied if the there are areas where extra flow is required. It provides a plow that can be modified using hand tools, without welding.

Figure 11A:
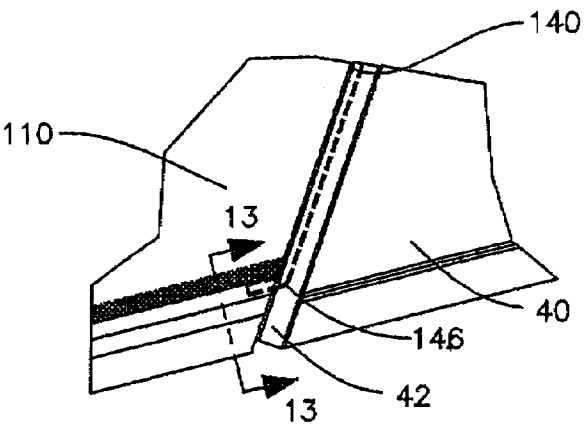
FIG. 11A is an enlarged view of the part marked 11A in FIG. 11.
Figure 11:
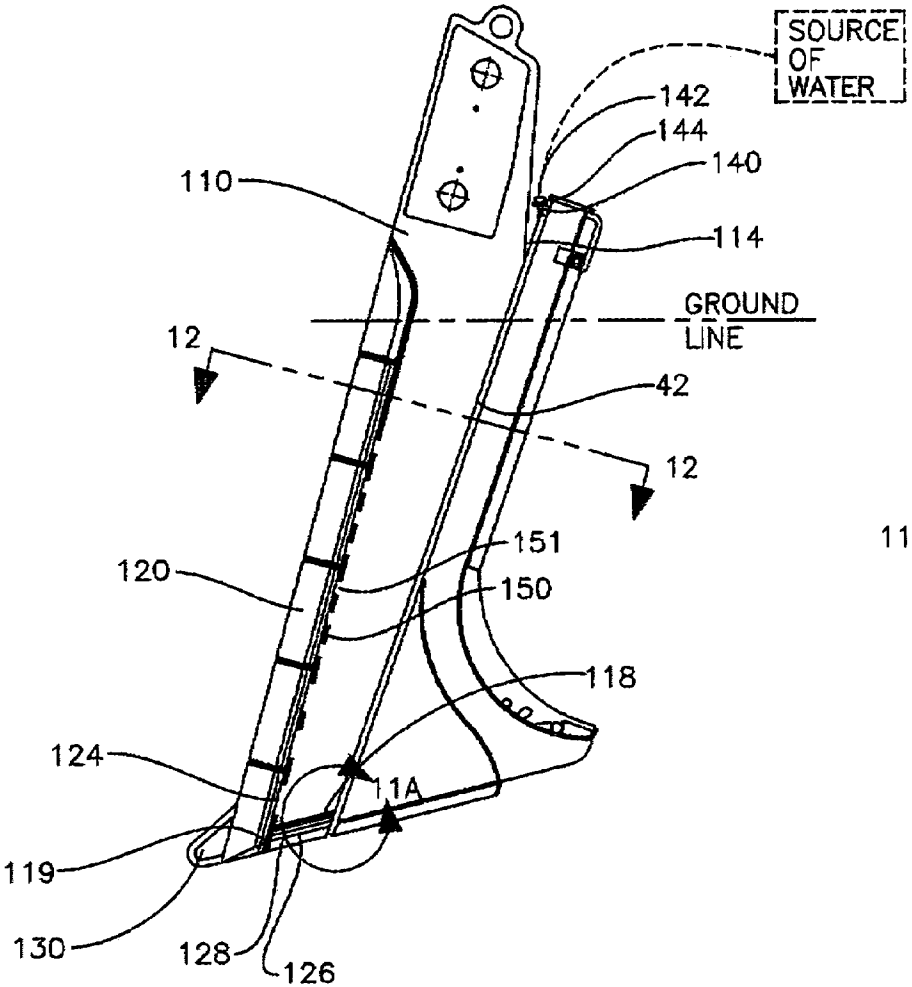
FIG. 11 is a side view of another preferred embodiment of a plow constructed in a manner of the present invention.
Figure 12:
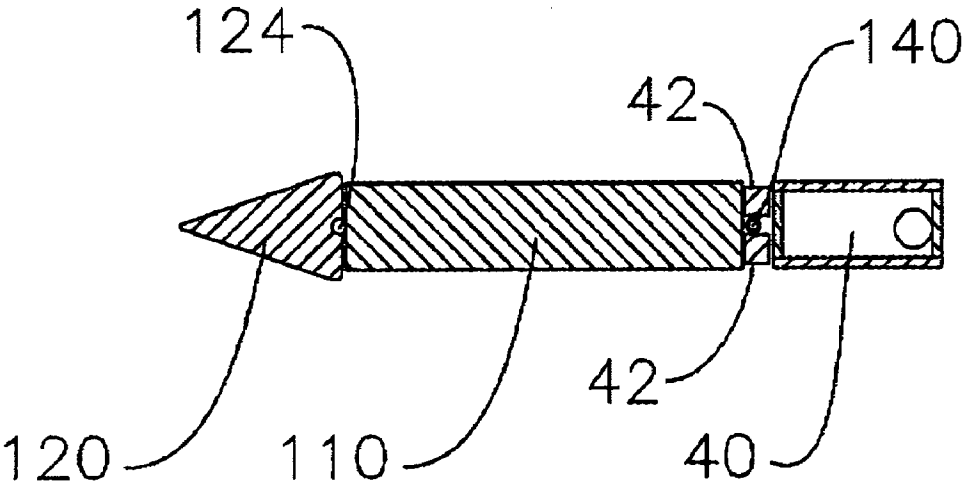
FIG. 12 is a cross-section taken along plane 12—12 as illustrated in FIG. 11.

Still another preferred embodiment is illustrated in FIGS. 11, 11A, 12 and 13. In this embodiment the fluid tube 140 has been located on the opposite side of blade 110, the rear side 114. As can be seen in FIG. 12 the fluid tube is located between the blade 110 and the chute 40. In this configuration it is protected by plates 42. The fluid tube includes an inlet fitting 142 at the top and travels to the bottom end 118 of blade 110 where it terminates at tube end 146. The cross hatched portion shown in FIG. 11A represents a weld.

Figure 13:
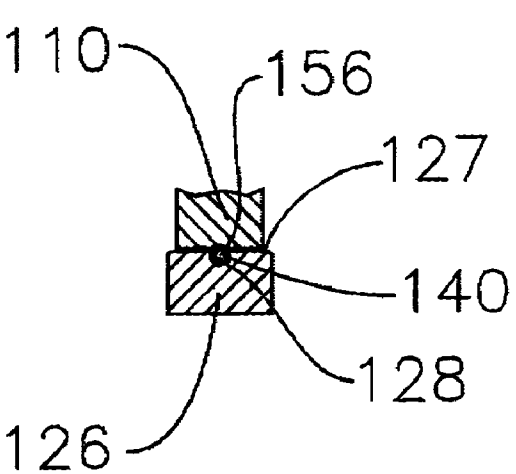
FIG. 13 is cross-section taken along plane 13—13 as illustrated in FIG. 11.
Figure 14:
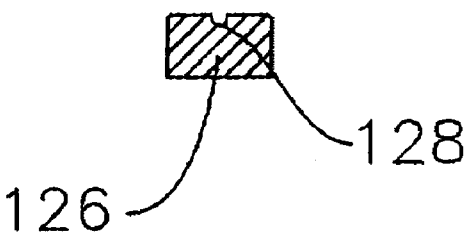
FIG. 14 is a partial cross-section taken along plane 13—13 as illustrated in FIG. 11.

Tube end 146 is adapted to attach to a bottom end section 126, as illustrated in FIG. 13. Bottom end section 126 includes void 128 in the top side 127 as illustrated in FIG. 14. Tube 140 includes a bend that allows it to enter into void. The tube 140 is then sealed by welding it to the bottom end section 126 and the blade 110 with weld 156 such that the fluid is forced into void 128. The bottom end section 126 is also welded to the blade 110 at the locations where it contacts the blade 110, thus sealing the void 128.

Void 128 intersects void 124 at the bottom-front corner of blade 110. At this point the fluid is transferred to void 124 and will flow along the front edge 112 of blade 110. As described for the previous two embodiments, the fluid can then be allowed to travel to the edge of the blade and out to the soil either through a gap and spaces between stitch welds 150, or through a manifold 160 between the front edge sections 120 and the blade 110. FIGS. 11 and 12 illustrate the use of the stitch welds 150 and gaps 151 between stitch welds 150. However, the manifold 160 would work equally well.

All the previously described embodiments provide a plow that can be tailored to provide fluid injection characteristics to match specific job requirements. The components are all manufactured with traditional manufacturing processes. The flow paths are defined by stacking together leading edge sections with flow voids, and welding or otherwise attaching them to a blade. This configuration provides appropriate function and provides an easily tailored configuration.

Obviously many modifications and variations of the present invention are possible in light of the above teachings. It is therefore to be understood that, within the scope of the appended claims, the invention may be practiced otherwise than as specifically described.

We claim:

1. A plow for use in installing utilities in the ground comprising:

(a) a leading edge section comprising:

i) a front edge; and ii) a side opposite the front edge including a sealing surface and fluid passage void (b) a blade comprising a front surface, a top end and a bottom end;

(c) wherein a fluid passage is defined by the fluid passage void of the leading edge section and the front surface of the blade when the leading edge is secured to the front surface of the blade; and (d) wherein the leading edge section is secured to the blade with stitch welds with a gap between the sealing surface of the leading edge and the front edge of the blade.

2. The plow of claim 1 further comprising a fluid tube that extends into the fluid passage.

3. The plow of claim 2 wherein the fluid tube extends into the fluid passage to near the bottom end of the blade.

* * * * *